US007371191B2

(12) United States Patent
Sugimoto

(10) Patent No.: US 7,371,191 B2
(45) Date of Patent: May 13, 2008

(54) GOLF CLUB HEAD

(75) Inventor: Yasushi Sugimoto, Kobe (JP)

(73) Assignee: SRI Sports Ltd., Kobe-shi (JP)

( * ) Notice: Subject to any disclaimer, the term of this patent is extended or adjusted under 35 U.S.C. 154(b) by 334 days.

(21) Appl. No.: 11/143,433

(22) Filed: Jun. 3, 2005

(65) Prior Publication Data

US 2006/0014592 A1 Jan. 19, 2006

(30) Foreign Application Priority Data

Jul. 13, 2004 (JP) ..... 2004-206282

(51) Int. Cl.
*A63B 53/04* (2006.01)

(52) U.S. Cl. ..... 473/345; 473/349

(58) Field of Classification Search ..... 473/324–350, 473/288–291

See application file for complete search history.

(56) References Cited

U.S. PATENT DOCUMENTS 4,021,047 A * 5/1977 Mader ..... 473/345
5,624,331 A * 4/1997 Lo et al. ..... 473/345
5,997,415 A * 12/1999 Wood ..... 473/346
6,059,669 A * 5/2000 Pearce ..... 473/339
6,527,650 B2 * 3/2003 Reyes et al. ..... 473/345
6,565,452 B2 * 5/2003 Helmstetter et al. ..... 473/342
6,575,845 B2 * 6/2003 Galloway et al. ..... 473/329
6,739,984 B1 * 5/2004 Ciasullo ..... 473/345
6,929,565 B2 * 8/2005 Nakahara et al. ..... 473/345
6,955,612 B2 * 10/2005 Lu ..... 473/324
6,969,326 B2 * 11/2005 De Shiell et al. ..... 473/345
7,008,332 B2 * 3/2006 Liou ..... 473/345
7,022,032 B2 * 4/2006 Chen ..... 473/346
7,108,612 B2 * 9/2006 Nakahara et al. ..... 473/329
2004/0053705 A1 * 3/2004 Kumamoto ..... 473/345
2004/0192468 A1 * 9/2004 Onoda et al. ..... 473/345
2005/0043115 A1 * 2/2005 Lin ..... 473/345
2005/0096154 A1 * 5/2005 Chen ..... 473/345
2005/0159243 A1 * 7/2005 Chuang ..... 473/345
2007/0032313 A1 * 2/2007 Serrano et al. ..... 473/349
2007/0049399 A1 * 3/2007 Matsunaga ..... 473/329

FOREIGN PATENT DOCUMENTS

JP 2003-199848 A 7/2003
JP 2003-250935 A 9/2003

* cited by examiner

*Primary Examiner*—Sebastiano Passaniti
(74) *Attorney, Agent, or Firm*—Birch, Stewart, Kolasch & Birch, LLP

(57) ABSTRACT

A hollow golf club head having a face portion for hitting a golf ball comprises a main body made of at least one kind of metal material, said main body having the face portion and at least two openings, and cover members attached to said main body so as to cover said openings, said cover members comprising at least one resin cover member made of a fiber reinforced resin and at least one metal cover member made of a metal material, and said resin cover member and said metal cover member each having specific gravity less than said main body.

14 Claims, 9 Drawing Sheets

GOLF CLUB HEAD

FIELD OF THE INVENTION

The present invention relates to a golf club head comprising a main body made of metal material and cover members having specific gravities less than the main body.

DESCRIPTION OF THE BACKGROUND ART

In recent years, hollow golf club heads made of a metallic main body and a cover member made of fiber reinforced resin have been proposed. These heads can save the weight thereof on the basis of the small specific gravity of the resin. Further, the saved weight can be allocated, for example, in the toe side, the heel side or the back face of the head. Therefore, these heads make it possible to improve a degree of freedom in the weight allocation design.

However, above mentioned head have bad sounds when hitting a ball (it is hereafter called "hitting sounds".). Specifically, there is a tendency for the hitting sounds to be low and for the reverberation to be also short.

SUMMARY OF THE INVENTION

It is therefore, one of an object of the present invention to provide a golf club head in which the hitting sounds is improved. Further, it is one of the other objects of the present invention to provide the golf club head in which the durability and the degree of freedom in weight allocation design are improved.

According to the present invention, a golf club head comprises a hollow golf club head having a face portion for hitting a golf ball comprising a main body made of at least one kind of metal material, said main body having the face portion and at least two openings, and cover members attached to said main body so as to cover said openings, said cover members comprising at least one resin cover member made of a fiber reinforced resin and at least one metal cover member made of a metal material, and said resin cover member and said metal cover member each having specific gravity less than said main body.

DESCRIPTION OF THE PREFERRED EMBODIMENTS

Figure 1:
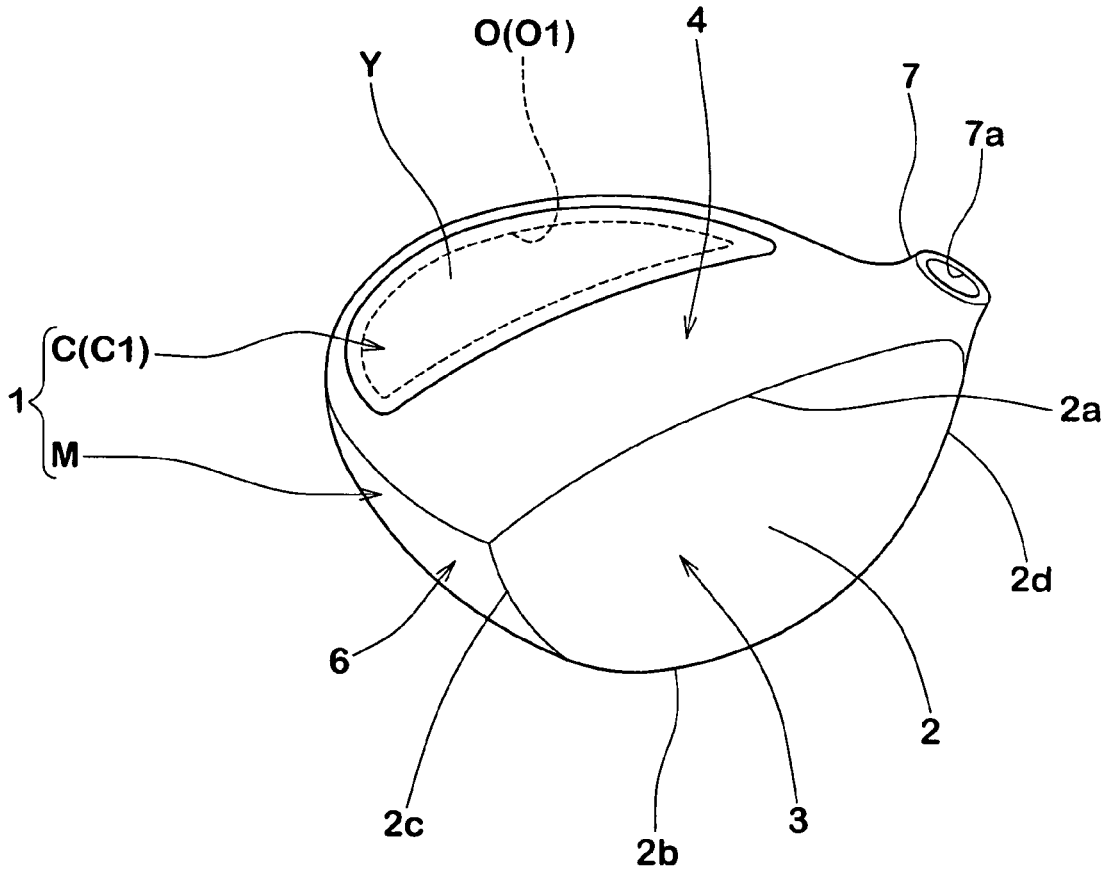
FIG. 1 is a perspective view of a wood-type gold club head according to the present invention.

Embodiments of the present invention will now be described in detail in conjunction with the accompanying drawings.

FIGS. 1 to 5 show a standard condition in which a golf club head 1 according to the present embodiment is grounded on a horizontal surface HP at a prescribed lie angle $\alpha$ and the loft angle $\beta$ (real loft). In the drawings, the club head 1 according to the present invention is a hollow wood-type club head such as #1 driver and fairway wood having a cavity i therein.

The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and the sole portion 5 which extends from a toe-side edge 2*c* to a heel-side edge 2*d* of the club face 2 through the back face of the club head; and a neck portion 7 having a shaft insert hole 7*a* to be attached to an end of a club shaft (not shown). An axial center line CL of the shaft insert hole 7*a* is used in the case of aligning the head 1 with the lie angle $\alpha$.

The head 1 according to the present embodiment has a volume preferably equal to or more than 300 $cm^3$, more preferably equal to or more than 400 $cm^3$, and further preferably equal to or more than 420 $cm^3$. Therefore, it is possible to increase a comfort level when ready to hit the ball, and it is possible to widen a sweet area and a moment of inertia. In this case, an upper limit of the head volume is not particularly limited, however, it is desirable that it is, for example, equal to or less than 500 $cm^3$, and on the basis of a rule regulation of R&A and USGA, it is preferable to restrict to be equal to or less than 470 $cm^3$.

Figure 6:
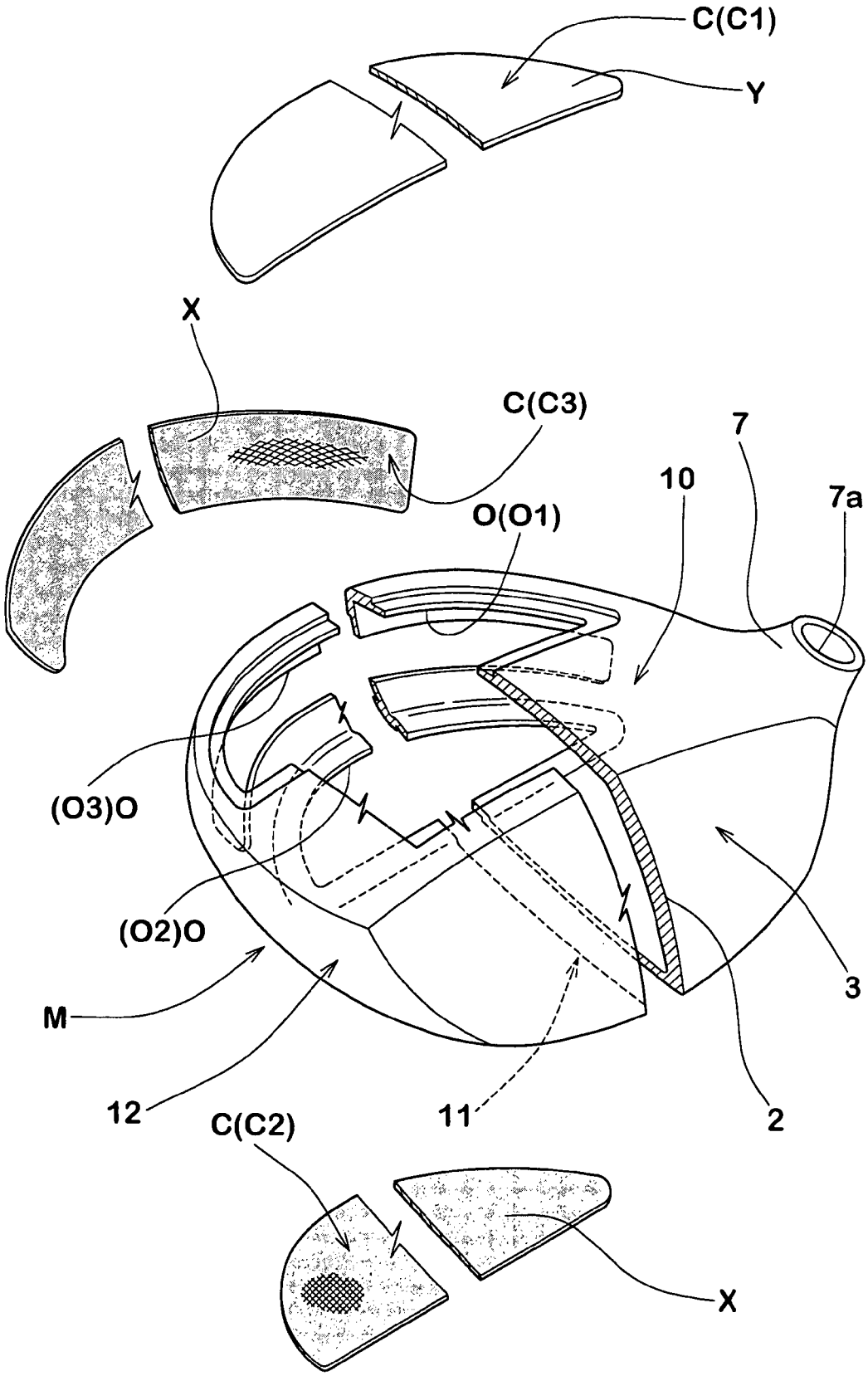
FIG. 6 is an exploded perspective view showing a main body and cover members.

As shown in FIG. 6, the head 1 according to the present embodiment comprises a main body M made of metal material having at least two openings O and at least two cover members C attached to the main body M so as to cover the openings O.

In this embodiment, the main body M comprises three openings comprising an upper opening O1 which is provided the highest position, a lower opening O2 which is provided the lowest position and a middle opening O3 which is provided between the upper opening O1 and the lower opening O2. These openings O1, O2 and O3 are provided in the positions except the face portion 3. Here, the shaft insert hole 7*a* is not included in the number of the openings. Further, in this embodiment, the cover members C comprise an upper cover C1 which covers with the upper opening O1, a lower cover C2 which covers with the lower opening O2 and a middle cover C3 which covers the middle opening O3.

The openings O1, O2 and O3 make it possible to reduce an amount of metal material in the main body M. Therefore, the head 1 according to the present embodiment can produce a light weight head and/or improve degree of freedom in a weight allocation design or the like. Further, by providing two or more openings O, each opening area can be made small Also, the strength reduction of the main body M can be prevented without reduction of a total area of the openings. In this point of view, the number of openings is preferably not less than two, more preferably not less than three. On the other hand, in the view of productivity of the main body M, the number of the openings is preferably not more than five, more preferably not more than four.

The main body M comprises: the face portion 3; a crown main wall 10 forming a part of the crown portion 4 and surrounding the upper opening O1; a sole main wall 11 forming a part of the sole portion 5 and surrounding the lower opening O2; a side main wall 12 forming a part of the side portion 6 and surrounding the middle opening O3; and the neck portion 7. These openings O1 to O3 are provided in portions except the face portion 3.

The main body M according to the present embodiment is integrally formed in each of the portions by casting. Such main body M makes it possible to get an exact size about the lie and the loft angles. Further, since the main body M comprises the side main wall 12, much weight is distributed by a circumference of the head 1. Therefore, it is possible to make a head having a large moment of inertia. According to another embodiment, the main body M is formed by forming two or more parts according to a working method such as forging, casting, pressing or rolling and thereafter integrally fixing them according to welding or the like.

In this embodiment, the main body M is made of a titanium alloy such as Ti-6Al-4V suitable for the casting. The titanium alloy has a specific gravity in the range of from about 4.4 to about 4.5.

With respect to the specific gravity ρ1 of the main body M, if it is too small, there is a tendency for the moment of inertia of the head 1 to become small. On the contrary, if the specific gravity ρ1 is too large, there is a tendency that an enlargement of head volume is difficult. In this point of view, the specific gravity ρ1 of the main body M is preferably not less than 2.0, more preferably not less than 4.0, but not more than 10.0, more preferably not more than 9.0.

As for the metal material satisfied the specific gravity can employ, for example, a stainless steel (ex. ρ1≅7.8), a maraging steel (ex. ρ1≅7.7), an aluminum alloy (ex. ρ1≅2.7), an amorphous alloy (ex. ρ1≅=7.6) or the like.

In this case, the main body M may be formed by using two or more kinds of metal materials. Here, the specific gravity is a ratio of the density of a target material to the density of a standard material which is water at 4 Celsius degrees.

Figure 5:
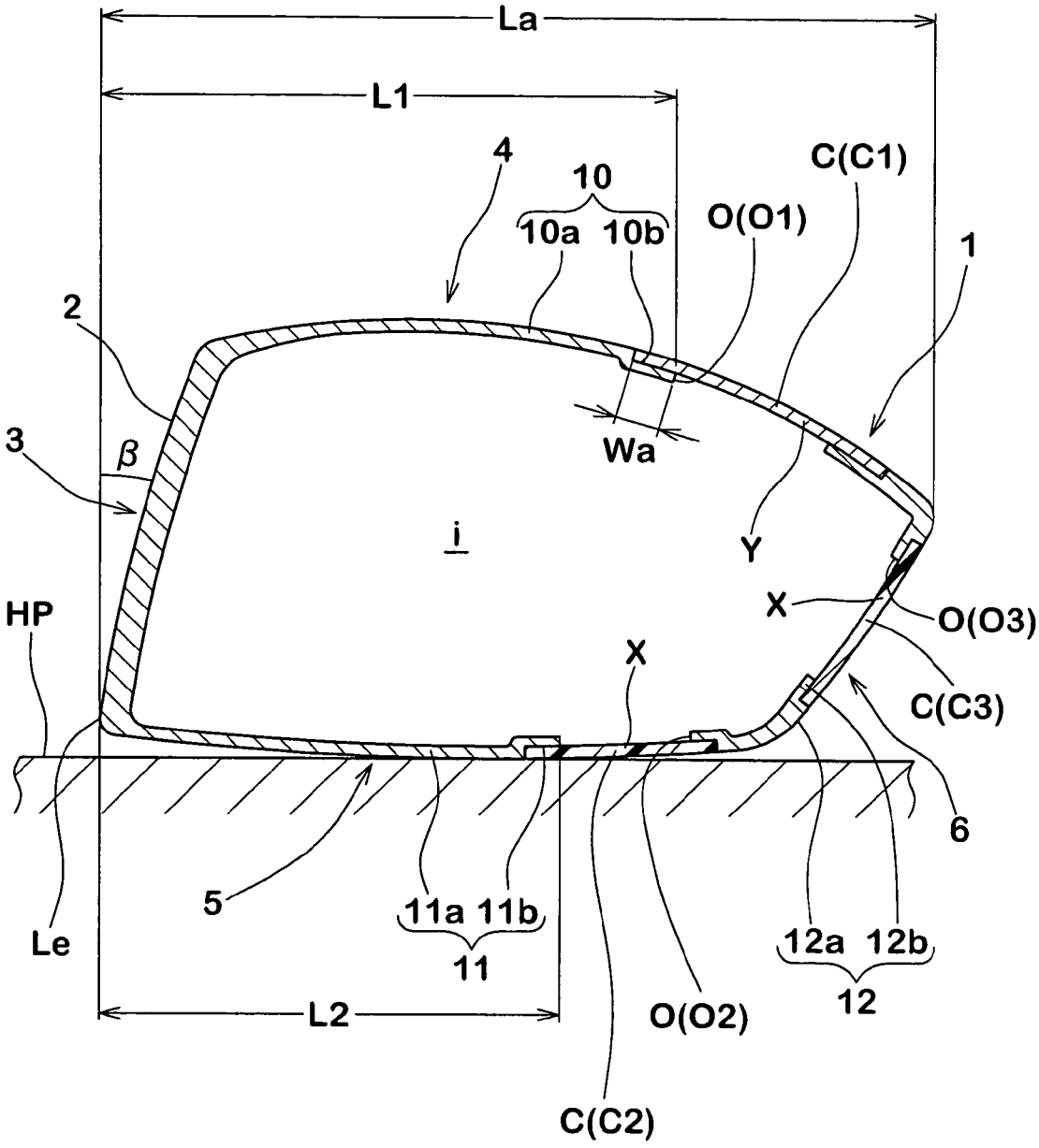
FIG. 5 is a cross sectional view taken on line A-A in FIG. 2.

As shown in FIG. 5, the crown main wall 10 comprises a crown body portion 10*a* forming an outer and inner surfaces of the crown portion 4 and a crown receiving portion 10*b* surrounding the upper opening O1. The crown receiving portion 10*b* has a stepped face to contact and support the inner surface of the peripheral portion of the upper cover C1.

In this embodiment, the upper opening O1 is provided in the back face side of the crown portion 4. The club face side in the crown portion 4 receives a large impact force at the time of a hit ball. Therefore, by providing the upper opening O1 for the position which is far from the club face 2, the durability of the head can be improved.

In this embodiment as shown in FIGS. 1 to 6, the shape of the upper opening O1 comprises a front edge O1*e* substantially parallel to the upper edge 2*a* of the club face 2 and a back edge O1*r* substantially parallel to the crown back edge 4B. As the result, the upper opening O1 has a crescent-shape or the like.

It is not particular limited, it is desirable that a ratio (L1/La) between a head length La corresponding a maximum length in a front-back direction from a leading edge Le (a position closest to the club face 2 in the standard condition) of the club head 1 to a head aftermost position, and a shortest distance L1 in the front-back direction from the leading edge Le to the upper opening O1 is preferably not less than 0.15, more preferably not less than 0.20, and still more preferably not less than 0.40. On the other hand, if the shortest distance L1 is too great, there is a tendency that the area of the upper opening O1 becomes small, whereby the head 1 tends to have a high center of gravity G. From this point of view, it is desirable that the ratio (L1/La) is preferably not more than 0.85, more preferably not more than 0.80, and still more preferably not more than 0.60.

Figure 2:
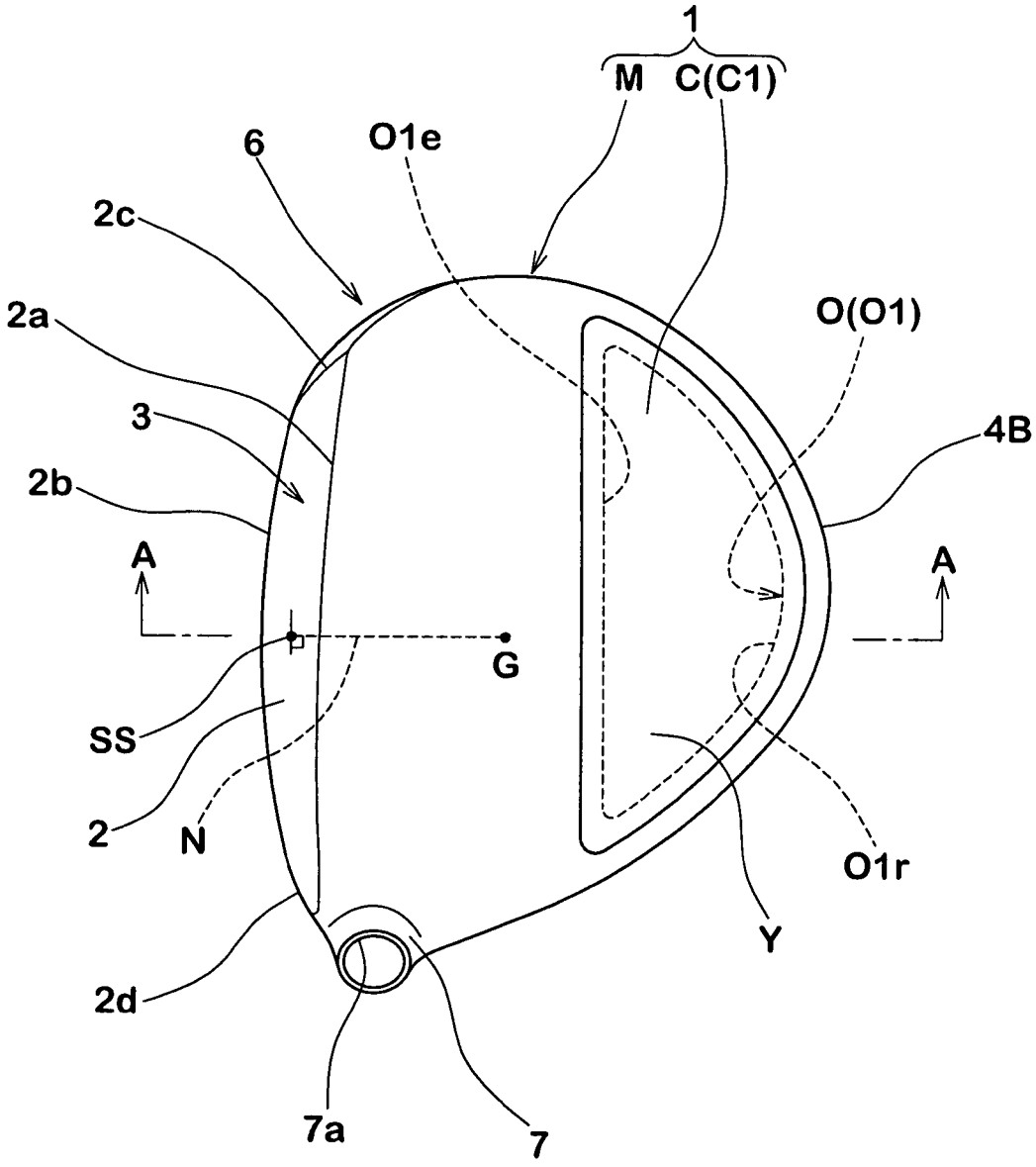
FIG. 2 is a plan view thereof.

Here, the front-back direction is a direction which is parallel to the normal line N drawn to the club face 2 from the center of gravity G of the head 1 in a plan view in the standard condition, as illustrated in FIG. 2.

As shown in FIG. 5, the sole main wall 11 comprises a sole body portion 11*a* forming an outer and inner surfaces of the sole portion 5 and a sole receiving portion 11*b* surrounding the lower opening O2. The sole receiving portion 11*b* also has a stepped face to contact and support the inner surface of the peripheral portion of the lower cover C2.

The shape of the sole opening O2 comprises a front edge O2*e* substantially parallel to the lower edge 2*b* of the club face 2 and a back edge O2*r* substantially parallel to the sole back edge 5B. AS the result, the lower opening O1 has a crescent-shape or the like.

Figure 4:
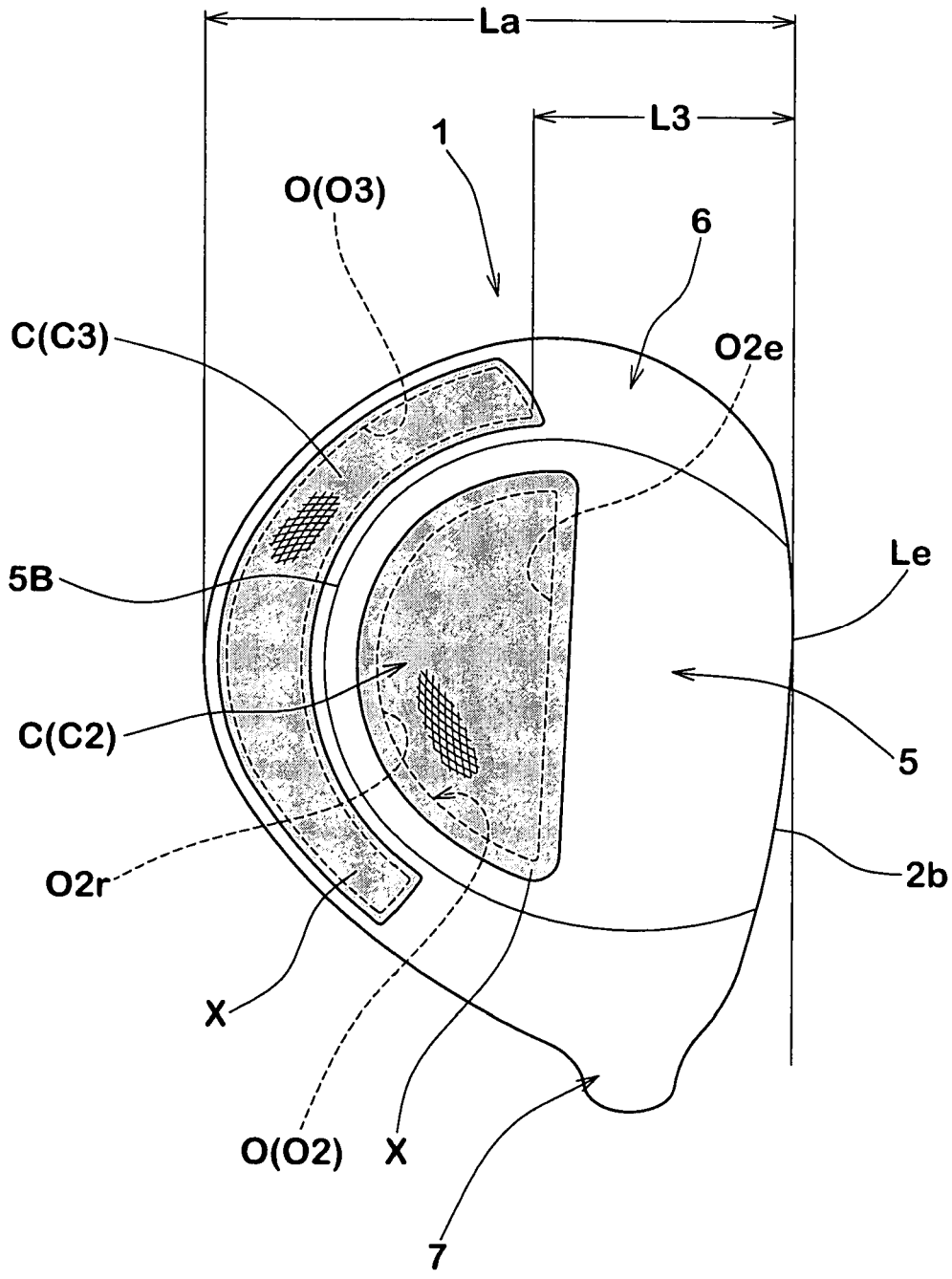
FIG. 4 is a bottom view of the head.

In this embodiment as illustrated in FIGS. 4 and 5, the lower opening O2 is provided in the back face side of the sole portion 5. By providing the lower opening O2 for the position which is far from the club face 2, the durability of the head is improved further. The same reason as the case of the crown main wall 10, a ratio (L2/La) between the head length La and a shortest distance L2 in the front-back direction from the leading edge Le to the lower opening O2 is preferably not less than 0.15, more preferably not less than 0.20, and still more preferably not less than 0.30, but not more than 0.70, more preferably not more than 0.60, and still more preferably not more than 0.50.

As illustrated in FIGS. 4 and 5, the side main wall 12 comprises a side body portion 12*a* forming an outer and an inner surfaces of the side portion 6 and a side receiving portion 12*b* surrounding the middle opening O3. The side receiving portion 12*b* also has a stepped face to contact and support the inner surface of the peripheral portion of the middle cover C3.

In this embodiment, the middle opening O3 is provided in the back face side in the side portion 6. A ratio (L3/La) between the head length La and a shortest distance L3 in the front-back direction from the leading edge Le to the middle opening O3 is preferably not less than 0.20, more preferably not less than 0.30, still more preferably not less than 0.50, but not more than 0.80, more preferably not more than 0.70, still more preferably not more than 0.60.

In order to improve the durability of the head 1, it is preferably to limit at least one, more preferably two and further preferably three of the ratio (L1/La), (L2/La) and/or (L3/La).

Each step of the receiving portion 10*b*, 11*b* and 12*b* is substantially equal to each thickness of the cover member C1, C2 and C3 attached thereto. Therefore, each receiving portion 10*b*, 11*b* and 12*b* supports each cover member C1, C2 and C3 with the outer surface thereof being flush with the outer surface of each body portion 10*a*, 11*a* and 12*a*. Thereby, a polishing process etc. can be skipped and the productivity of the head 1 improves.

In this embodiment, each cover member C1, C2 and C3 is fixed to each receiving portion 10*b*, 11*b* and 12*b* by means of an adhesive agent or the like. As shown in FIG. 5, a width Wa of the each receiving portion 10*b*, 11*b* and 12*b* measured in a perpendicular direction from the edge of each opening O is not particularly limited, however, if it is too small, the adhesive area between the main body M and the cover members C becomes small, whereby an adhesive strength tends to be lowered, and if it is inversely too large, the area of the openings O become small, whereby there is a tendency that the weight saving effect can not be sufficiently obtained. From this point of view, it is desirable that the width Wa is preferably not less than 5.0 mm, more preferably not less than 10.0 mm, but not more than 30.0 mm, more preferably not more than 20.0 mm, and still more preferably not more than 15.0 mm. In this case, the width Wa may be fixed, or may be changed.

Figure 3:
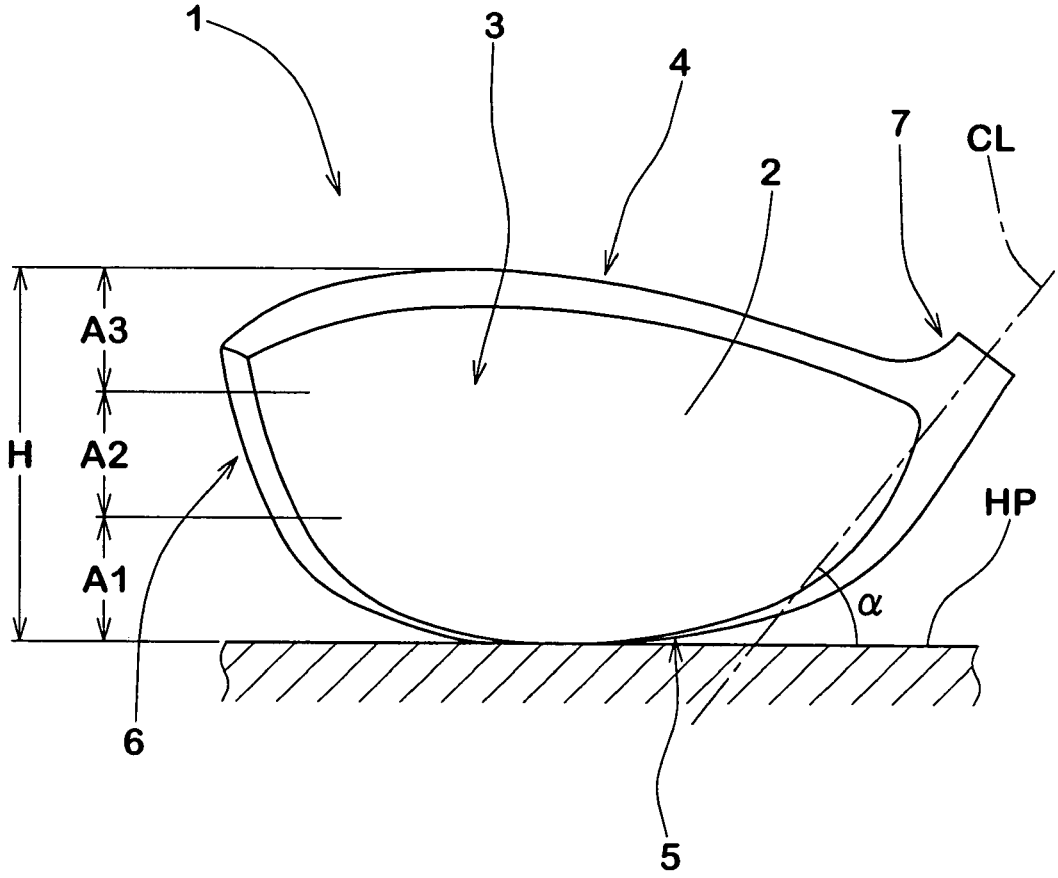
FIG. 3 is a front view of the head.

In the standard condition as shown in FIG. 3, the openings O comprise preferably at least two zones of a lower zone A1 which is ⅓ or less of a maximum head height H which is a maximum height from the horizontal surface HP to the crown portion 3, an upper zone A3 which is ⅔ or more of the height H from the horizontal surface HP, and a middle zone A2 which is a zone between the lower zone A1 and the upper zone A3. Thereby, the openings O can be distributed in the wide range of the head 1, and a large opening area as a whole is obtained, preventing the fall of head rigidity.

Especially, it is desirable that at least 60% of a surface area of the upper opening O1 is located in the upper zone A3. Further, it is desirable that at least 60% of a surface area of the lower opening O2 is located in the lower zone A1. In this embodiment, the entire surface area of the upper opening O1 is located in the upper zone A3, and the entire surface area of the lower opening O2 is located in the lower zone A1. Further, at least 60% of a surface area of the middle opening O3 is located in the middle zone A2. Therefore, in according to the present embodiment, the openings O are located in each zone A1, A2 and A3.

Here, the surface areas of the openings O each are the surface area which is projected onto the surface of the head 1.

As shown in FIG. 6, each cover member C1, C2 and C3 is formed as a thin-plate curved smoothly with the shape which suits the shape of each opening O. In this embodiment, each cover C1, C2 and C3 is formed separately from the main body M, and is fixed to each receiving portion 10*b*, 11*b* and 12*b* so as to cover each opening O.

The cover members C comprise at least one resin cover member X made of a fiber reinforced resin having a specific gravity ρ3 less than the main body M, and at least one metal cover member Y made of metal material having a specific gravity ρ2 less than the main body M. In this embodiment, the lower and the middle covers C2 and C3 are formed as the resin cover member x, and the upper cover member C1 is formed as the metal cover member Y. Here, when the main body M is made of two or more kinds of metal materials, the specific gravity ρ1 of the main body M is obtained from the mean density which is a ratio of the mass and the volume of the main body M.

The fiber reinforced resin is composed of a matrix resin and reinforcing fibers, and has the smaller specific gravity ρ3 in comparison with the main body M. Accordingly, the head 1 according to the present embodiment can obtain a comparatively great weight saving effect in the sole portion 5 and side portion 6 by employing the resin cover members X. The saved weight is, for example, distributed to a proper portion of the main body M in order to make the center G of gravity low and/or to enlarge the moment inertia.

If the specific gravity ρ3 of the fiber reinforced resin is too small, the intensity of the resin falls easily, conversely, if the specific gravity ρ3 is too large, it is difficult to improve the flexibility of a weight distribution design of the head 1. In this point of view, a ratio (ρ3/ρ1) between the specific gravity ρ3 of the fiber reinforced resin and the specific gravity ρ1 of the main body M is preferable not less than 0.10, and more preferably not less than 0.15, but not more than 0.8, more preferably not more than 0.7, and still more preferably not more than 0.5.

As for the matrix resin, for example, an epoxy resin, an unsaturated polyester resin, a vinyl ether resin, a phenol resin, a nylon resin and a polycarbonate resin may be used. Further, as for the fibers, for example, a carbon fiber; a glass fiber; an organic fiber such as an aramid fiber, a polyphenylene benzoxazole resin fiber (PBO fiber) or the like; and a metal fiber such as an amorphous fiber, a titanium fiber or the like may be used. Especially, the carbon fiber having a small specific gravity and a large tensile elastic strength is preferable. Here, the fibers comprise short fibers and/or long fibers.

Further, a tensile elastic modulus of the fiber is not particularly limited, however, if it is too small, it is impossible to secure a rigidity of the resin covers X and the durability tends to be lowered, and if it is inversely too large, the cost thereof is increased, and the tensile strength tends to be lowered. From this point of view, it is desired that the elastic modulus of the fiber is preferably not less than 50 GPa, more preferably not less than 100 GPa, and still more preferably not less than 200 GPa, but preferably not more than 450 GPa, more preferably not more than 350 GPa, and still more preferably not more than 300 GPa. In this case, the elastic modulus of the fiber corresponds to an elastic modulus in tension, and is constituted by a value measured according to "carbon fiber test method" in JIS R7601. In this embodiment, the resin cover members X are made of the fiber reinforced resin which is compounded the epoxy resin and the carbon fibers.

According to the present embodiment, the specific gravity ρ2 of the metal cover member Y is larger than the resin cover members X, but it is less than the main body M. The metal material of the metal cover Y is not particular limited, however, there can be listed up, for example, a magnesium alloy (ρ2≅1.7), an aluminum alloy (ρ2≅2.7), and/or a titanium alloy having a small specific gravity less than the main body M. In this embodiment, as for the metal cover Y, the magnesium alloy is used.

The head which comprises two or more cover members of all from fiber reinforced resin has some negative characteristic at the time of hitting a ball such as a large energy loss, fall of rebounding performance, and low hitting sounds with short reverberation. As opposite to this, according to the present invention, the metal cover member Y makes it possible to make the reverberation of hitting sounds maintain, and to solve the other mentioned negative characteristic without the increase in large weight of the head.

Especially, since the crown portion 4 bends greatly in elasticity by hitting a ball, the property of the crown portion 4 has much influence on the hitting sounds and the energy loss. Therefore, in accordance with the present embodiment, it is possible to obtain high hitting sounds with long reverberation, low energy loss and high durability by using the metal cover member Y in the crown portion 4. On the other hand, in accordance with the present embodiment, it is also possible to get a margin in a weight enough and high degree of freedom in the weight allocation design by using the resin cover members X for the middle and lower cover members C2 and C3 disposed in the sole and side portions 5 and 6 which has not much influence on the hitting sounds and energy loss. With thus, the head 1 of the present embodiment, it is possible to improve the hitting sound, the durability and the flexibility of the freedom of weight design with sufficient balance.

Further, in order to improve the above mentioned effects, a ratio (ρ2/ρ1) between the specific gravity ρ2 of the metal cover member Y and the specific gravity ρ1 of the main body M is preferably not less than 0.15, and more preferably not less than 0.20, but preferably not more than 0.8, more preferably not more than 0.7, still more preferably not more than 0.5. If the specific gravity ρ2 is too small, there is a tendency that the intensity of the metal cover member Y becomes low, and if the specific gravity ρ2 is too large, it becomes difficult to fully improve the flexibility of a weight design.

In this embodiment as illustrated in FIGS. 1 to 6, if the specific gravity ρ2 of the metal cover Y becomes too large to the specific gravity ρ3 of the resin cover X, there is a tendency that the center G of gravity of the head 1 becomes high. In this point of view, the specific gravity ρ2 is preferably not more than 1.2 times, and more preferably not more than 0.9 times of the specific gravity ρ3 of the resin cover X.

In order to improve above mentioned effects enough, a ratio (S2/S3) between a total area S3 of the surface area of all openings O covered with the resin cover members X and a total area S2 of the surface area of all opening(s) O covered with the metal cover member(s) Y is preferably not less than 0.2, more preferably not less than 0.3, but preferably not more than 0.8, more preferably nor more than 0.6, and further preferably not more than 0.4. If the ratio (S2/S3) is too small, the hitting sounds can not be improved since the surface area of the metal cover member Y becomes too small. On the other hand, if the ratio (S2/S3) is too large, the degree of freedom in the weight allocation design can not be improved since the surface area of the resin cover X becomes too small.

Further, in order to improve the hitting sounds, the energy loss and the durability of the head 1, a total opening area (S2+S3) of the area S2 and the area S3 is preferably not less than 15%, more preferably not less than 20%, further preferably not less than 30%, but not more than 70%, more preferably not more than 60%, still more preferably not more than 50% of the entire surface of the head 1. The entire surface area of the head 1 is measured on the condition at which the shaft insert hole 7*a* was plugged up beforehand.

Further, in order to improve the hitting sounds, the energy loss and the durability of the head 1, the surface area of each opening O1, O2 and O3 is preferably not less than 3%, more preferably not less than 5%, but preferably not more than 40%, more preferably not more than 35% still more preferably not more than 30% of the entire surface area of the head 1. Needless to say, the area of each opening O does not need to be the same.

With respect to the manufacturing method of the resin cover members X, it is also possible to use a so-called internal pressure forming method of integrally forming the cover member C with the main body M at the same time of molding, for example, by attaching at least one uncured prepreg sheet to the receiving portion 11*b* and 12*b* so as to cover the opening O2 and O3, and molding this in a mold (not shown). In this method, an expanding bladder is beforehand allotted to the cavity i of the main body M. Thus, the prepreg sheet receives heat and pressure from inside and outside, and is molded by desirable shape.

Figure 7:
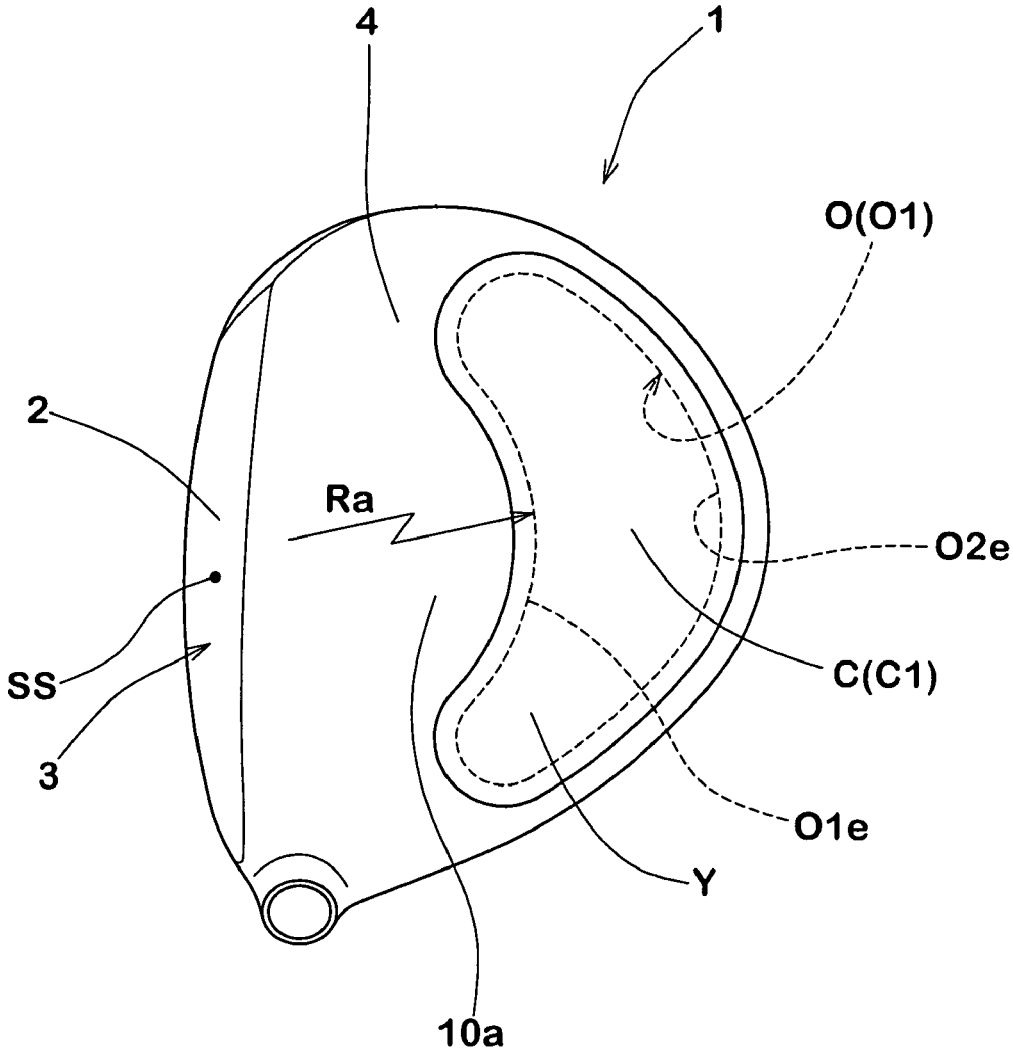
FIG. 7 is a plan view showing another embodiment head of the present invention.

FIG. 7 shows another embodiment of the head 1 in according with the present invention. In plan view of the standard condition, the head 1 has the upper opening O1 with a curved front edge O1*e* in the side of the club face 2. The curved front edge O1*e* is a circular curve which projects smoothly toward the back face of the head 1. AS the result, both the toe side and the heel side parts of the upper opening O1 extend toward the club face 2 compared with the center part thereof.

The upper opening O1 in accordance present embodiment can give sufficient rigidity to the center of the crown portion 4 which receives large impact force especially, without a reduction of the area of the upper opening O1. Thereby, the head 1 in according with the present embodiment can improve both the durability and the hitting sounds further. It is not limited, but the radius of curvature Ra of the curved front edge 01*e* is preferably set in the range of from 50 mm to 150 mm.

The present invention suitably applied to wood-type hollow heads such as driver and fairway wood, but it is also possible to apply the invention to other types of club heads such as utility-type, iron-type, and patter-type. Further, the shapes of the openings etc. can be changed variously. Further, in the other embodiment in accordance with the present invention, there is a case that the number of the cover members C is fewer than the number of the openings O.

Comparison Tests:

Golf club heads for #1 wood having a volume of 400 $cm^3$, an entire surface area of 300 $cm^2$, a loft angle of 11 degrees and a lie angle of 57 degrees were made and tested for the hitting sounds, durability and rebound performance.

Figure 8:
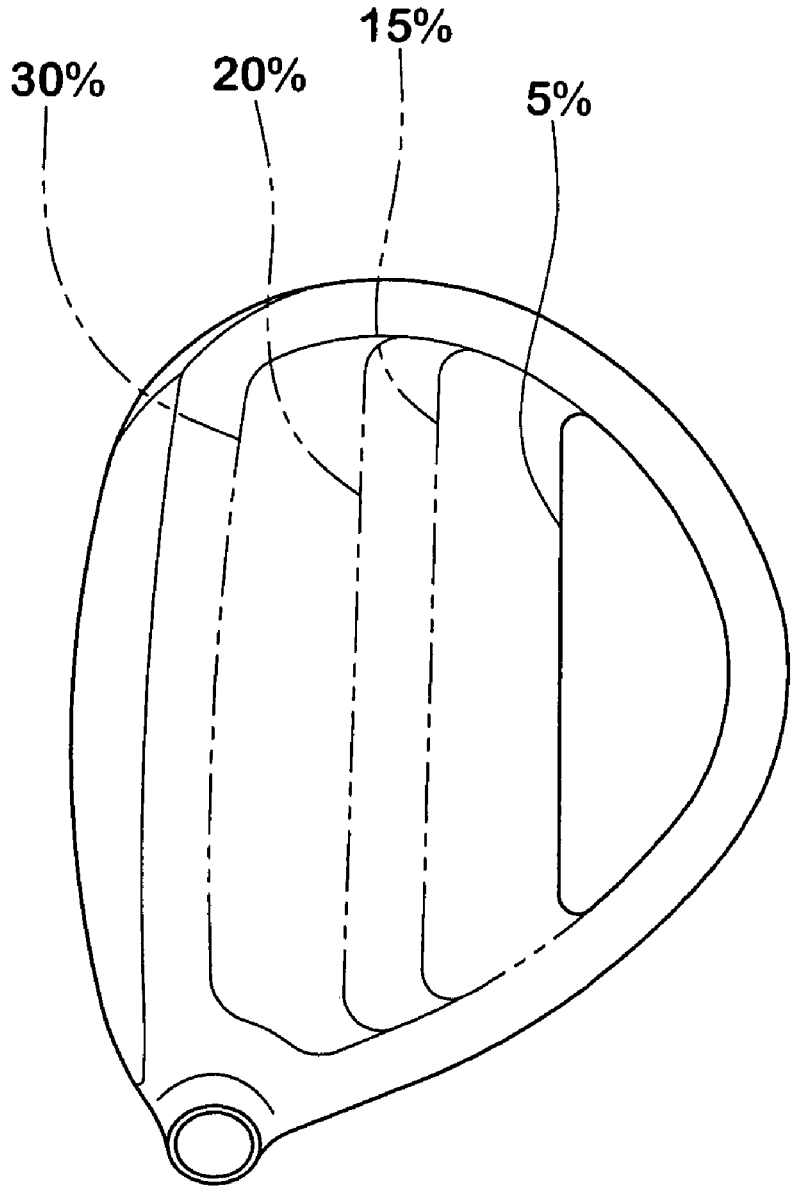
FIG. 8 is a plan view showing the main body.
Figure 9:
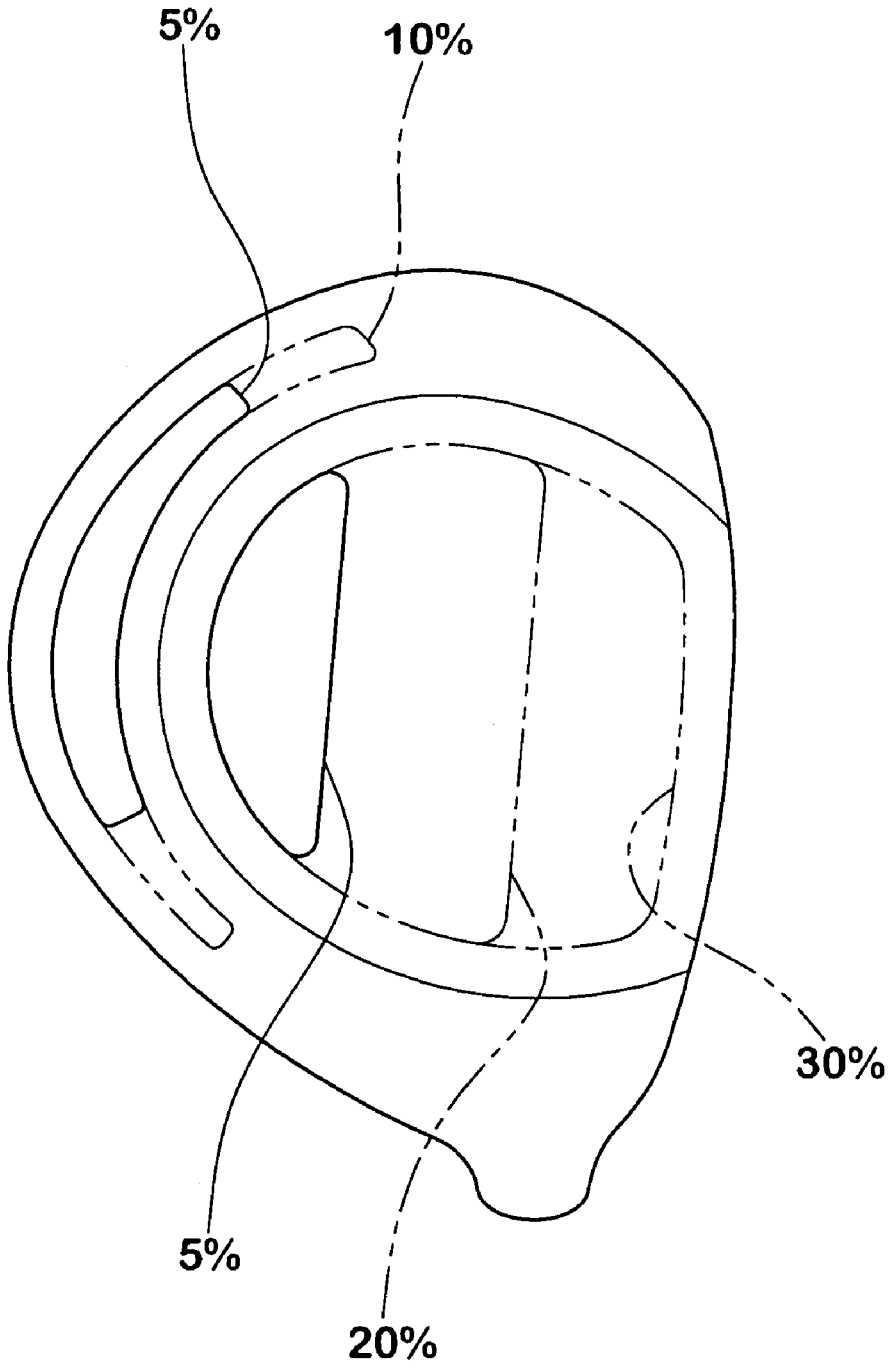
FIG. 9 is a bottom view showing the main body.

The main body was made by casting a titanium alloy Ti-6Al-4V having a specific gravity ρ1 of 4.5. The plan view and bottom view of the main body are shown in FIGS. 8 to 9. In FIGS. 8 to 9, two dotted lines show the outline when changing the shape of openings.

Each resin cover member (CFRP) was formed as a thin-plate having the thickness of about 0.8 mm and the specific gravity ρ3 of 1.6 by using five uni-directional prepreg plies and a mold. The prepreg plies comprise a bisphenol A epoxy resin and parallel carbon fibers "HR40" manufactured by Mitsubishi Rayon Co., Ltd. having a tensile elastic modulus of 392 GPa. The prepreg plies further comprise first plies with a fiber orientation parallel to the front-back direction and second plies with fiber orientation parallel to the toe-heel direction alternately.

A metal cover member was formed as using a magnesium alloy having the thickness of about 1.0 mm and the specific gravity ρ2 of 1.6. Each cover member was joined with each receiving portion of the openings by using an adhesive agent.

Further, a method of evaluation is as follows.

Hitting Sounds:

Each club head was attached to a carbon shaft "MP-200 (Frex. R) made by SRI sports, Co., Ltd." to manufacture a 45-inch wood type golf club. Then, ten golfers hit the golf balls and evaluated the hitting sound by using the above-mentioned clubs. Then, the number of the golfer who felt that it was better than the hitting sounds of reference 1 was shown about each club. The larger the value, the better the hitting sounds.

Moment of Inertia:

A lateral moment of inertia is the moment of inertia around the vertical axis passing through the center G of gravity in the standard condition. A vertical moment of inertia is the moment of inertia around a horizontal axis passing through the center of gravity G in the toe-heel direction of the head in the standard condition. These moments were measured with "Moment of Inertia Measuring Instrument MODEL NO. 005-002, INERTIA DYNAMICS Inc." The larger the value, the better the Moment of inertia.

Rebound Performance:

According to the "Procedure for Measuring the Velocity Ratio of a Club Head for Conformance to Rule 4-1e, Appendix II, Revision 2 (Feb. 8, 1999), United States Golf Association", the restitution coefficient of each club head was obtained. The larger the value, the better the rebound performance.

Durability:

The above-mentioned each club was attached to a swing robot and hit golf balls again and again at a head speed of 50 m/s at the sweet spot of the face to count up the number of hits (Max.=4000 times) until a damage was observed in the head.

The results are shown in Table 1.

TABLE 1

| | | Ref. 1 | Ref. 2 | Ref. 3 | Ref. 4 | Ex. 1 | Ex. 2 | Ex. 3 | Ex. 4 | Ref. 5 |
|---|---|---|---|---|---|---|---|---|---|---|
| Entire surface area of Head S[$cm^2$] | | | | | | 300 | | | | |
| Upper opening | | | | | | | | | | |
| Surface area/S[%] | | 5 | 5 | 20 | 30 | 5 | 15 | 20 | 30 | 30 |
| Cover material | | CFRP | CFRP | CFRP | CFRP | | | Magnesium Alloy | | |
| Middle opening | | | | | | | | | | |
| Surface area/S[%] | | 0 | 5 | 5 | 10 | 5 | 5 | 5 | 10 | 10 |
| Cover material | | — | CFRP | CFRP | CFRP | CFRP | CFRP | CFRP | CFRP | Mg. Alloy |
| Lower opening | | | | | | | | | | |
| Surface area/S[%] | | 0 | 5 | 30 | 30 | 5 | 20 | 30 | 30 | 30 |
| Cover material | | — | CFRP | CFRP | CFRP | CFRP | CFRP | CFRP | CFRP | Mg. Alloy |
| Total area of all openings (S2 + S3)/S[%] | | 5 | 15 | 55 | 70 | 15 | 40 | 55 | 70 | 70 |
| Total area of opening covered with metal cover member S2/S[%] | | 0 | 0 | 0 | 0 | 5 | 15 | 20 | 30 | 70 |
| Total area(s) of opening covered with resin cover member(s) S3/S[%] | | 5 | 15 | 55 | 70 | 10 | 25 | 35 | 40 | 0 |
| Ratio (S2/S3) | | 0 | 0 | 0 | 0 | 0.5 | 0.6 | 0.57 | 0.25 | — |
| Head weight [index number] | | 100 | 100 | 100 | 100 | 100 | 100 | 100 | 100 | 100 |
| Ratio (ρ2/ρ1) | | — | — | — | — | 0.4 | 0.4 | 0.4 | 0.4 | 0.4 |
| Ratio (ρ3/ρ1) | | 0.35 | 0.35 | 0.35 | 0.35 | 0.35 | 0.35 | 0.35 | 0.35 | — |
| Ratio (ρ2/ρ3) | | 0 | 0 | 0 | 0 | 1.13 | 1.13 | 1.13 | 1.13 | — |
| Test result | Hitting sound [*] | — | 2 | 1 | 0 | 9 | 8 | 8 | 8 | 8 |
| | Durability [ball number] | No damage | 3700 | 3700 | 3600 | No damage | 3900 | 3850 | 3800 | 3500 |
| | Rebound performance | 0.850 | 0.846 | 0.840 | 0.835 | 0.849 | 0.848 | 0.847 | 0.845 | 0.846 |
| | Lateral moment of inertia [g · $cm^2$] | 3500 | 3800 | 4100 | 4300 | 3750 | 3880 | 4050 | 4240 | 3880 |
| | Horizontal moment of inertia [g · $cm^2$] | 2000 | 2050 | 2300 | 2500 | 2020 | 2150 | 2260 | 2450 | 1980 |

[*] It indicates the number of tester(s) who felt better hitting sounds than the Ref. 1.

From the test results it was confirmed that the hitting sounds, the rebound performance and the durability can be improved. Further, it was also confirmed that the flexibility of a weight allocation design was high, since the moment of inertia is large.

The invention claimed is:

1. A hollow golf club head having a face portion for striking a golf ball comprising a main body made of at least one kind of metal material, said main body having the face portion and at least two distinct openings, and cover members attached to said main body so as to cover said openings, said cover members comprising at least one resin cover member made of a fiber reinforced resin and at least one metal cover member made of a metal material, and said resin cover member and said metal cover member each having a specific gravity less than said main body, wherein the openings comprise an upper opening covered with the metal cover member and a lower opening covered with the resin cover member.

2. The golf club head according to claim 1, wherein the head has a volume in the range of from 300 $cm^3$ to 500 $cm^3$.

3. The golf club head according to claim 1, wherein a total area of all the openings projected onto a surface of the head is in the range of from 15% to 70% of the entire surface area of the head.

4. The golf club head according to claims 1 or 2 wherein
a total area of all the openings projected onto a surface of the head is in the range of from 30% to 70% of the entire surface area of the head.

5. The golf club head according to claim 1, wherein
in a standard condition in which the head is grounded on a horizontal surface at a prescribed lie and loft angles thereof, wherein
the openings are provided in at least two zones of a lower zone which is ⅓ or less of a maximum head height from the horizontal surface, an upper zone which is ⅔0 or more of the maximum head height from the horizontal surface, and a middle zone which is a zone between the lower zone and the upper zone.

6. The golf club head according to claim 1 or 5, wherein
the main body comprises three distinct openings which include the upper opening, the lower opening and a middle opening provided between the upper opening and the lower opening.

7. The golf club head according to claim 5, wherein
at least 60% surface area of the upper opening is in the upper zone, and
at least 60% surface area of the lower opening is in the lower zone.

8. The golf club head according to claim 7, wherein
the openings comprise
at least one middle opening located between the upper opening and the lower opening and covered with the resin cover member.

9. The golf club head according to claim 1, 2 or 3, wherein
a ratio (S2/S3) between a total area S3 of the surface areas of all said openings covered with the resin cover members and the total area S2 of the surface areas of all said openings covered with the metal cover members is in the range of 0.2 to 0.8.

10. The golf club head according to claim 1, wherein
said each opening has an surface area projected on the head surface being in the range of from 3% to 40% of the entire surface of the head.

11. The golf club head according to claim 1, wherein
said upper opening is provided in a crown portion of the main body,
said upper opening comprises a curved front edge by the side of the face portion, and
in a plan view of the club head, the curved front edge includes a center part extending in a circular curve having a center of curvature on the face portion side.

12. The golf club head according to claim 1, wherein
the ratio (L2/La) between a head length La corresponding to a maximum length in a front-back direction of the head and a horizontal shortest distance L2 from a leading edge to the lower opening is not less than 0.30.

13. A hollow golf club head having a face portion for striking a golf ball comprising
a main body made of at least one kind of metal material, said main body having the face portion and at least two distinct openings including an upper opening and a lower opening, and
cover members attached to said main body so as to cover said openings, said cover members comprising
at least one resin cover member made of a fiber reinforced resin and
at least one metal cover member made of a metal material, and
said resin cover member and said metal cover member each having specific gravity less than said main body, wherein
a ratio (S2/S3) between a total area S3 of the surface areas of all said openings covered with the resin cover members and a total area S2 of the surface areas of all said openings covered with the metal cover members is in the range of 0.2 to 0.8, and
the metal cover is made of a magnesium alloy.

14. A hollow golf club head having a face portion for striking a golf ball comprising
a main body made of at least one kind of metal material, said main body having the face portion and at least two distinct openings including an upper opening and a lower opening, and
cover members attached to said main body so as to cover said openings, said cover members comprising
at least one resin cover member made of a fiber reinforced resin and
at least one metal cover member made of a metal material, and
said resin cover member and said metal cover member each having specific gravity less than said main body, wherein
said upper opening is provided in a crown portion of the main body,
said upper opening comprises a curved front edge adjacent to the face portion, and
in a plan view of the club head, the curved front edge includes a center part extending in a circular curve having a center of curvature on the face portion side.

* * * * *